US011882980B2

(12) United States Patent
Terrádez Alemany et al.

(10) Patent No.: US 11,882,980 B2
(45) Date of Patent: Jan. 30, 2024

(54) HOUSEHOLD DISHWASHER MACHINE AND METHOD FOR OPERATING A HOUSEHOLD DISHWASHER MACHINE

(71) Applicant: BSH Hausgeräte GmbH, Munich (DE)

(72) Inventors: Maria Terrádez Alemany, Munich (DE); Kai Paintner, Welden (DE); Matthias Heckes, Munich (DE); Daniel Hitzler, Dillingen (DE)

(73) Assignee: BSH Hausgeräte GmbH, Munich (DE)

( * ) Notice: Subject to any disclaimer, the term of this patent is extended or adjusted under 35 U.S.C. 154(b) by 562 days.

(21) Appl. No.: 16/617,535

(22) PCT Filed: Jul. 6, 2018

(86) PCT No.: PCT/EP2018/068328
§ 371 (c)(1),
(2) Date: Nov. 27, 2019

(87) PCT Pub. No.: WO2019/015989
PCT Pub. Date: Jan. 24, 2019

(65) Prior Publication Data

US 2020/0178755 A1 Jun. 11, 2020

(30) Foreign Application Priority Data

Jul. 19, 2017 (DE) ..... 10 2017 212 323.0

(51) Int. Cl.
*A47L 15/42* (2006.01)
*A47L 15/00* (2006.01)
*A47L 15/46* (2006.01)

(52) U.S. Cl.
CPC ..... *A47L 15/4295* (2013.01); *A47L 15/0021* (2013.01); *A47L 15/46* (2013.01);
(Continued)

(58) Field of Classification Search
CPC ..... A47L 15/0021; A47L 15/0049; A47L 15/4295; A47L 15/46; A47L 2401/04;
(Continued)

(56) References Cited

U.S. PATENT DOCUMENTS 10,080,477 B2 9/2018 Fauth et al.
2007/0181162 A1* 8/2007 Classen ..... A47L 15/4295 134/25.2

(Continued)

FOREIGN PATENT DOCUMENTS

DE 10048081 A1 4/2002
EP 1116471 A2 * 7/2001 ..... A47L 15/4295

(Continued)

OTHER PUBLICATIONS

EP1116471—Machine Translation (Year: 2001).*

(Continued)

*Primary Examiner* — Marc Lorenzi
(74) *Attorney, Agent, or Firm* — Michael E. Tschupp; Andre Pallapies; Brandon G. Braun

(57) ABSTRACT

A household dishwasher includes a washing chamber, a controller apparatus configured to perform a wash program from a number of wash programs for washing items to be washed arranged in the washing chamber, an optical sensor configured to capture an optical sensor signal of the washing chamber during performance of the wash program, and an evaluating unit configured to ascertain a subsequent loading of items to be washed by a user as a function of the captured optical sensor signal of the washing chamber, to determine a point in time of the subsequent loading in the wash program, and to perform a predetermined action as a function of the ascertained subsequent loading and the determined point in time.

8 Claims, 3 Drawing Sheets

(52) U.S. Cl.
CPC ..... *A47L 2401/04* (2013.01); *A47L 2401/20* (2013.01); *A47L 2401/26* (2013.01); *A47L 2501/26* (2013.01); *A47L 2501/30* (2013.01)

(58) Field of Classification Search
CPC ..... A47L 2401/20; A47L 2401/26; A47L 2401/30; A47L 2501/30
See application file for complete search history.

(56) References Cited

U.S. PATENT DOCUMENTS

2010/0294311 A1 11/2010 Classen et al.
2010/0294321 A1* 11/2010 Rosenbauer ..... A47L 15/0047 134/25.2
2010/0328450 A1* 12/2010 Wagner ..... D06F 34/28 348/135
2012/0138092 A1* 6/2012 Ashrafzadeh ..... A47L 15/4295 134/18
2016/0227980 A1* 8/2016 Peukert ..... A47L 15/0021
2017/0202426 A1* 7/2017 Bosen ..... A47L 15/4295

FOREIGN PATENT DOCUMENTS

EP 1192893 A2 4/2002
JP 2009056161 A 3/2009
WO WO-2004071681 A1 * 8/2004 ..... G06T 7/0004

OTHER PUBLICATIONS

JP2009056161—Machine Translation (Year: 2009).*
National Search Report DE 10 2017 212 323.0 dated Apr. 11, 2018.
International Search Report PCT/EP2018/068328 dated Oct. 8, 2019.
National Search Report CN 2018800475238 dated Jul. 13, 2022.

* cited by examiner

HOUSEHOLD DISHWASHER MACHINE AND METHOD FOR OPERATING A HOUSEHOLD DISHWASHER MACHINE

CROSS-REFERENCES TO RELATED APPLICATIONS

This application is the U.S. National Stage of International Application No. PCT/EP2018/068328, filed Jul. 6, 2018, which designated the United States and has been published as International Publication No. WO 2019/015989 A1 and which claims the priority of German Patent Application, Serial No. 10 2017 212 323.0, filed Jul. 19, 2017, pursuant to 35 U.S.C. 119(a)-(d).

BACKGROUND OF THE INVENTION

The present invention relates to a household dishwasher and also a method for operating a household dishwasher.

In conventional household dishwashers, it often happens that a user subsequently loads further items to be washed for washing after starting a wash program. This may have various consequences. On the one hand, the point in time of the subsequent loading may be so late that a complete cleaning of the loaded items to be washed is no longer ensured. This may also further lead to the already-loaded items to be washed in the household dishwasher being soiled again. On the other hand, known household dishwashers have an adding unit for detergent and rinse-aid, which add detergent starting from an initial state at a first actuation and only add rinse-aid at the second actuation. If, for subsequently loading the items to be washed, the door of the household dishwasher is opened, it happens that the adding unit is reset. If the point in time lies after the point in time for adding the detergent, then rinse-aid should be added at the next actuation. However, as the adding unit is in the initial state, no rinse-aid is added at first. This leads to insufficient rinse-aid being added overall during the rinsing with rinse-aid cycle, whereby the drying of the items to be washed is impaired.

DE 10 2004 035 847 A1 describes a method for identifying the loading of a dishwasher with items to be washed by means of an image capturing system.

BRIEF SUMMARY OF THE INVENTION

Against this background, an object of the present invention consists in disclosing an improved household dishwasher.

Accordingly, a household dishwasher is proposed with a controller apparatus for performing one wash program from a number of wash programs for washing items to be washed arranged in a washing chamber. The household dishwasher has an optical sensor for capturing an optical sensor signal of the washing chamber during a performance of the wash program. It further has an evaluating unit which is configured to ascertain a subsequent loading of items to be washed by a user as a function of the captured optical sensor signal of the washing chamber, to determine a point in time of the subsequent loading in the wash program and to perform a predetermined action as a function of the ascertained subsequent loading and the determined point in time.

Such a household dishwasher in particular has the advantage that a predetermined cleaning result is ensured, even if the user subsequently adds items to be washed at an unsuitable point in time, in a large quantity and/or with a great degree of soiling. As a result of the predetermined cleaning result being ensured for all the items to be washed, it is also possible for energy, time and/or costs to be saved, since for example it is possible to avoid subsequently washing by hand, drying by hand or performing a further run of the wash program with the same items to be washed.

The controller apparatus may be implemented in a hardware-based and/or also software-based manner. If implemented in a hardware-based manner, the controller apparatus may for example be embodied as a computer or as a microprocessor. If implemented in a software-based manner, the controller apparatus may be embodied as a computer program product, as a function, as a routine, as part of a program code or as an executable object.

The controller apparatus is configured for performing one wash program from a number of wash programs. The number for example comprises different wash programs, such as an energy-saving wash program, a glass-care wash program, an intensive wash program, an automatic wash program and/or a machine-cleaning wash program. The various wash programs in particular differ in a sequence of sub-program steps and/or in parameter values for the individual sub-program steps. Sub-program steps in particular comprise a pre-rinse, a cleaning, a rinsing with rinse-aid and a drying. Parameter values in particular comprise a washing liquor temperature, a quantity of fresh water supplied, a pump speed of a recirculating pump, an amount of dosed cleaning agent, an amount of dosed rinse-aid, a point in time of adding the cleaning agent and/or the rinse-aid, a duration of a sub-program step and/or an activation of further supporting units, such as a zeolite drying apparatus for example.

The washing container of the household dishwasher is in particular formed by a dishwasher cavity closed off by a door of the household dishwasher. The dishwasher cavity for example has a bottom, a ceiling, a rear wall and two side walls and thus forms a cuboid which is open on one side. The open side may be opened or closed off by the door. In particular, there is provision in the washing chamber for at least one receptacle for items to be washed, which for example is embodied such that it can be pulled out from the washing chamber, fastened to rails, when the door is opened, so that items to be washed can be loaded in a convenient manner.

The optical sensor is in particular embodied as an optoelectronic sensor, which supplies an analog electrical signal as a function of an optical signal as the optical sensor signal. This offers the advantage that the optical sensor is produced and can be used on a microchip in an integrated design and thus in a space-saving, material-saving and cost-effective manner. The analog electrical signal is further able to be converted into a digital signal with little outlay, for example by means of an A/D converter, and subsequently can be processed digitally.

The optical sensor is arranged in the household dishwasher in such a manner that it captures an optical sensor signal of the washing chamber of the household dishwasher. This is fulfilled, for example, if a line of sight from the optical sensor to the washing chamber is present. For example, the optical sensor is arranged on the ceiling of the dishwasher cavity, on the rear wall of the dishwasher cavity and/or on a door of the household dishwasher, which in the closed state forms the washing chamber with the dishwasher cavity. There may be further provision for a plurality of optical sensors to be used, wherein each optical sensor captures an optical sensor signal of a region of the washing chamber assigned to the respective optical sensor.

The optical sensor captures the optical sensor signal while the wash program is being performed. This is understood as meaning, for example, that the wash program has been started, but has not yet finished. Even if the wash program is interrupted, for example because the door of the household dishwasher has been opened, then this falls within the period of time referred to.

The optical sensor signal includes the items to be washed arranged in the washing chamber, in that the optical sensor captures an optical sensor signal of the washing chamber. Advantageously, the optical sensor is arranged such that, when the door of the household dishwasher is opened, it also captures a region in front of the washing chamber, in particular the region in which the receptacle for items to be washed is situated in the pulled-out state. The entire region included by the optical sensor signal is also referred to in the following as the sensing region.

The optical sensor is in particular configured to capture the optical sensor signal over a wide spectral range, which is not limited to the optical spectral range. For example, the optical sensor comprises an infrared sensor. Using this, a temperature of the items to be washed can be captured. Subsequently loaded items to be washed in particular have a lower temperature than items to be washed which have already been heated by warm washing liquor. Thus, it is possible to deduce from the temperature of the items to be washed, whether subsequently loaded items to be washed are involved.

The optical sensor for example comprises a camera, in particular a digital camera, for example with a CCD sensor (CCD: Charged Coupled Device). The camera for example captures an image and/or a video of the sensing region.

An illumination device may be provided for support, which illuminates the sensing region. This illumination device may, in particular, be embodied as a narrowband light source, such as a laser for example. Alternatively, the illumination device may be embodied as a wideband light source, such as a lightbulb and/or a flash device.

The evaluating unit may be implemented in a hardware-based and/or also software-based manner. If implemented in a hardware-based manner, the evaluating unit may for example be embodied as a computer or as a microprocessor. If implemented in a software-based manner, the evaluating unit may be embodied as a computer program product, as a function, as a routine, as part of a program code or as an executable object. The evaluating unit may in particular be embodied as part of the controller apparatus.

The evaluating unit is configured to ascertain a subsequent loading of items to be washed as a function of the captured optical sensor signal. For example, the evaluating unit processes and/or analyzes the optical sensor signal for this purpose. The evaluating unit may for example be configured to perform a spectral analysis of the optical sensor signal. In particular, such an analysis of an infrared spectral range of the captured optical sensor signal makes it possible to ascertain various temperatures of the items to be washed, as well as chemical compounds. From the ascertained chemical compounds, it is possible to infer a type of the items to be washed for example, such as plastic, porcelain, glass, metal, as well as the soiling which is adhering to the items to be washed, such as fat, carbohydrate, protein and the like for example. Subsequent loading is understood, for example, to mean adding further items to be washed, altering an arrangement of the items to be washed in the washing chamber and/or removing items to be washed.

The evaluating unit may in particular be configured to not only ascertain whether items to be washed have been subsequently loaded at all, but also the quantity of items to be washed which have been subsequently loaded, the type of subsequently loaded items to be washed, the severity of the soiling of the subsequently loaded items to be washed, for example with food residues, and/or the position in the washing chamber at which the subsequently loaded items to be washed are arranged.

If the optical sensor is embodied as a camera, then the evaluating unit may in particular be configured to perform an image analysis of the optical sensor signal present as an image. In this context, an image analysis comprises an identification of a type of the subsequently loaded items to be washed, of a position of the subsequently loaded items to be washed, of soiled regions on the subsequently loaded items to be washed and/or of the type of soiling of the subsequently loaded items to be washed.

The evaluating unit is further configured to determine the point in time of the subsequent loading in the wash program. For example, this is understood to mean that the evaluating unit determines, in relation to the performed wash program, whether an addition of the cleaning agent has already taken place, whether a pre-rinsing has already been finished, whether a cleaning has already been finished and/or whether a rinsing with rinse-aid has already been started.

The evaluating unit performs a predetermined action as a function of the ascertained subsequent loading and the determined point in time.

In accordance with an embodiment of the household dishwasher, the predetermined action comprises an output of an item of information to the user and/or an adjustment of the wash program currently being performed.

This action, for example, is an adjustment of the wash program currently being performed, in particular of parameter values of individual sub-program steps. There may also be provision for completely substituting the wash program currently being performed with another wash program from the number of wash programs, and to start it anew or even continue it midway through. Furthermore, for example, individual sub-program steps may be inserted into the wash program currently being performed.

The output of an item of information to the user may for example take place by means of a display element, such as a display on the household dishwasher, or also as an acoustic signal by means of a corresponding loudspeaker. There may be further provision for transferring the information to a mobile device, such as a smartphone for example, by means of a communications unit.

In principle, any measure which contributes to achieving a predefined cleaning result is possible as the predetermined action. The predefined cleaning result is in particular understood to mean a predefined cleanliness of the items to be washed in relation to macroscopic and microscopic soilings, as well as a predefined drying state after the wash program has concluded.

In accordance with a further embodiment of the household dishwasher, the evaluating unit is configured to determine the subsequent loading of items to be washed into the washing chamber as a function of an opening of a door of the household dishwasher and a closing of the door within a predetermined period of time while performing the wash program.

The opening and subsequent closing of the door of the household dishwasher is an indicator for whether items to be washed have been subsequently loaded. In this context, it is also possible to take into consideration how long the door was open. For example, there may be provision, when the door has only been open for less than three seconds for example, for the evaluating unit to ascertain that no items to be washed have been subsequently loaded.

In accordance with a further embodiment of the household dishwasher, this has an illumination device for illuminating the washing chamber when capturing the optical sensor signal.

The illumination device is in particular configured to illuminate the entire sensing region of the optical sensor. This embodiment is particularly advantageous, as it means that a good illumination of the washing chamber, in particular of the sensing region, is ensured when capturing the optical sensor signal by way of the optical sensor, whereby a good signal-to-noise ratio of the captured optical sensor signal is also ensured when using a simple and favorable optical sensor.

In accordance with a further embodiment of the household dishwasher, the optical sensor comprises a camera, wherein the optical sensor signal comprises an image and/or a video of the washing chamber.

In particular, it is relatively simple to ascertain by way of a before-after comparison of two images, wherein the first is captured before or directly when opening the door and the second is captured after or when closing the door, whether items to be washed have been subsequently loaded, an arrangement of the items to be washed in the washing chamber has been altered and/or items to be washed have been removed.

In accordance with a further embodiment of the household dishwasher, the evaluating unit is configured to perform an image analysis of the captured image and/or of the captured video in order to ascertain the subsequent loading of items to be washed.

In accordance with a further embodiment of the household dishwasher, the evaluating unit is configured to perform a spectral analysis of the captured optical sensor signal in order to ascertain the subsequent loading of items to be washed.

In accordance with a further embodiment of the household dishwasher, the evaluating unit is configured to ascertain a quantity of the subsequently loaded items to be washed, a type of the subsequently loaded items to be washed, a position of the subsequently loaded items to be washed in the washing chamber and/or a soiling of the subsequently loaded items to be washed.

A quantity is understood for example to mean a number of individual component items to be washed.

A type of the items to be washed is understood for example to mean a property of the items to be washed, in particular the materials comprised by the items to be washed, as well as a shape of the items to be washed.

The position of the items to be washed in the washing chamber in particular refers to the position when the receptacle for items to be washed has been pushed in.

The soiling of the items to be washed is understood for example to mean the amount of soiling as well as the type of soiling.

In accordance with a further embodiment of the household dishwasher, there is provision for a communications unit for bidirectional communication with an external controller device, wherein the evaluating unit is configured, as a function of the ascertained subsequent loading and the ascertained point in time, to use the communications unit to transmit an item of information to the external controller device and/or to receive a controller command from the external controller device.

The communications unit is in particular embodied as a modem and/or a network adapter. The external controller device is for example a central home controller system and/or a mobile device, in particular a smartphone, on which a suitable app is running.

In this embodiment, it is thus possible to supply the user with detailed information, for example whether the current wash program is being continued unaltered despite the subsequent loading, whether the user should subsequently load cleaning agent for example and/or whether the current wash program is adjusted in order to ensure a predefined cleaning result. Furthermore, the user himself may initiate or perform suitable countermeasures, possibly also on the suggestion of the evaluating unit. Many further embodiments are conceivable, in particular in relation to the predetermined action.

According to a further aspect, a method for operating a household dishwasher is proposed with a controller apparatus for performing one wash program from a number of wash programs for washing items to be washed arranged in a washing chamber. In a first method step, an optical sensor signal of the washing chamber is captured by means of an optical sensor during the performance of the wash program. In a second method step, a subsequent loading of items to be washed by a user is ascertained by means of an evaluating unit as a function of the captured optical sensor signal. In a third method step, a point in time of the ascertained subsequent loading in the wash program is determined. In a fourth method step, a predetermined action is performed as a function of the ascertained subsequent loading and the determined point in time of the subsequent loading.

This method advantageously makes it possible to optimize the operation of the household dishwasher on a subsequent loading of items to be washed during the performance of a wash program.

The embodiments and features described for the proposed household dishwasher apply correspondingly to the proposed method.

In embodiments of the method, there may be provision for transferring the captured optical sensor signal to a mobile device, in particular a smartphone, and/or to a server, such as a back-end for example. The mobile device and/or the server are in particular embodied as the evaluating unit and are configured to ascertain the subsequent loading as a function of the transferred sensor signal. The ascertaining of the subsequent loading may be performed on a mobile device, in particular by an app running on the mobile device.

Furthermore, a computer program product is proposed which causes the method, as described above, to be carried out on a program-controlled device.

A computer program product such as e.g. a computer program means, for example can be provided or supplied as a storage medium such as e.g. a memory card, USB stick, CD-ROM, DVD, or even in the form of a downloadable file from a server in a network. This may take place, for example, in a wireless communications network by transferring a corresponding file containing the computer program product or the computer program means.

Further possible implementations of the invention also include combinations of features or embodiments described above or below with regard to exemplary embodiments, even if these combinations are not mentioned explicitly. In this context, the person skilled in the art will also add individual aspects as improvements or enhancements to the respective basic form of the invention.

BRIEF DESCRIPTION OF THE DRAWINGS

Further advantageous embodiments and aspects of the invention form the subject matter of the subclaims and of the exemplary embodiments of the invention that are described below. The invention is also described in greater detail on the basis of preferred forms of embodiment with reference to the attached figures.

DETAILED DESCRIPTION OF EXEMPLARY EMBODIMENTS OF THE PRESENT INVENTION

Figure 1:
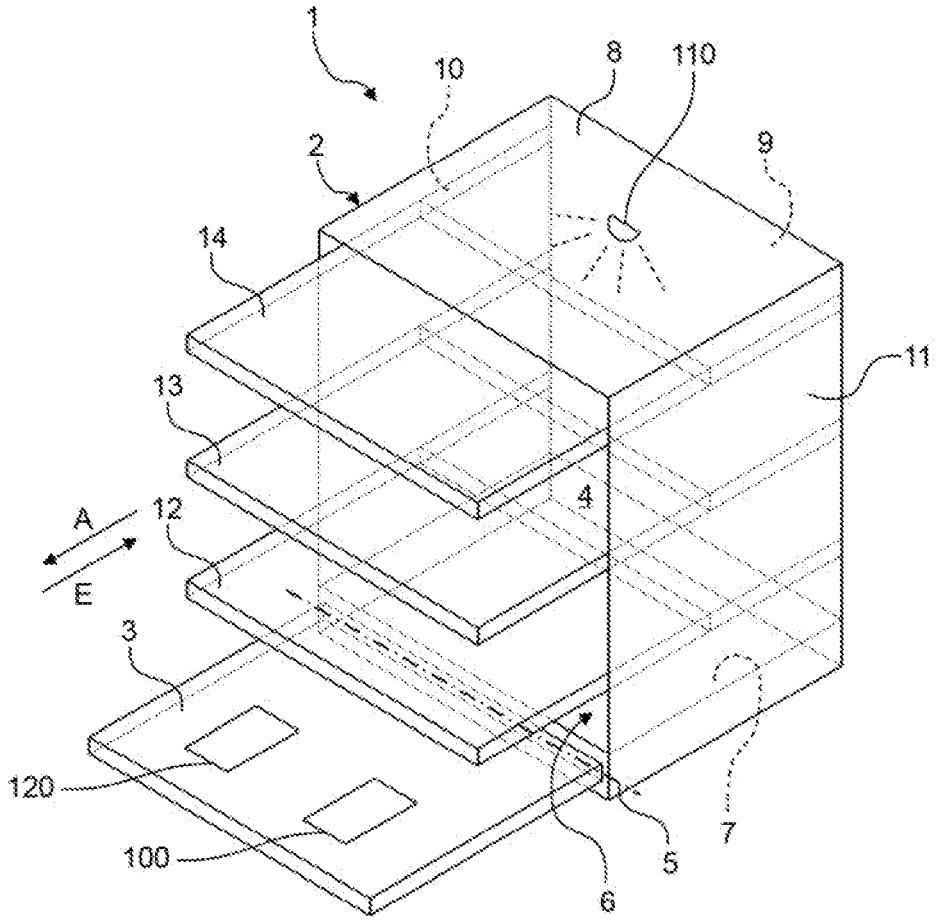
FIG. 1 shows a schematic perspective view of an exemplary embodiment of a household dishwasher.

In the figures, elements that are identical or have the same function are provided with the same reference characters unless specified otherwise.

FIG. 1 shows a schematic perspective view of an exemplary embodiment of a household dishwasher 1. The household dishwasher 1 comprises a dishwasher cavity 2, which is able to be closed off by a door 3, in particular in a watertight manner. A sealing facility (not shown) may be provided for this purpose between the door 3 and the dishwasher cavity 2. The dishwasher cavity 2 is preferably cuboid in shape. The dishwasher cavity 2 may be arranged in a housing of the household dishwasher 1. The dishwasher cavity 2 and the door 3 may form a washing chamber 4 for washing items to be washed 15, 20 (see FIG. 2).

The door 3 is shown in its open position in FIG. 1. The door 3 may be closed or opened by pivoting about a pivot axis 5 provided at a lower end of the door 3. With the aid of the door 3, a loading opening 6 of the dishwasher cavity 2 can be closed or opened. The dishwasher cavity 2 has a bottom 7, a ceiling 8 arranged opposite to the bottom 7, a rear wall 9 arranged opposite the closed door 3 and two side walls 10, 11 arranged opposite one another. The bottom 7, the ceiling 8, the rear wall 9 and the side walls 10, 11 may be manufactured from a stainless steel sheet for example. Alternatively, the bottom 7 may be manufactured from a plastic material.

Furthermore, the household dishwasher 1 has at least one receptacle for items to be washed 12, 13, 14. Preferably, a plurality of receptacles for items to be washed 12, 13, 14, for example three, may be provided, wherein the receptacle for items to be washed 12 may be a lower receptacle for items to be washed or a lower basket, the receptacle for items to be washed 13 may be an upper receptacle for items to be washed or an upper basket and the receptacle for items to be washed 14 may be a cutlery drawer. As additionally shown in FIG. 1, the receptacles for items to be washed 12, 13, 14 are arranged above one another in the dishwasher cavity 2. Each receptacle for items to be washed 12 to 14 is optionally able to be shifted into or out from the dishwasher cavity 2. Each receptacle for items to be washed 12, 13, 14 is able be inserted into the dishwasher cavity 2 in an insertion direction E and pulled out from the dishwasher cavity 2 in a pull-out direction A opposite to the insertion direction E.

The household dishwasher 1 additionally has a controller apparatus 100 and also an evaluating unit 120, which are arranged on the door 3. An optical sensor 110 embodied as a camera is arranged on the ceiling 8, so that it is configured for capturing an optical sensor signal of the washing chamber 4 and the items to be washed 15, 20 arranged in the washing chamber 4 (see FIG. 2). The dashed lines below the camera 110 indicate a capture region of the camera 110. It should be noted that the capture region is not limited to the washing chamber 4.

By combining the camera 110 and the evaluating unit 120, it is advantageously possible to ascertain a subsequent loading of items to be washed 20 into the washing chamber 4 during a performance of a wash program. This is explained in more detail below with reference to FIG. 2.

Figure 2:
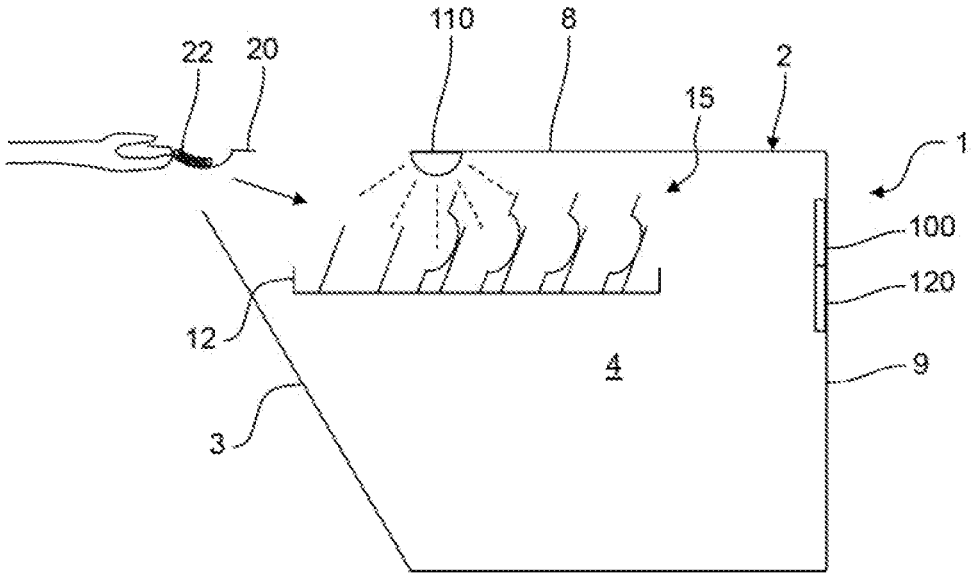
FIG. 2 shows a schematic side view of a further exemplary embodiment of a household dishwasher.

FIG. 2 shows a schematic side view of a further exemplary embodiment of a household dishwasher 1, for example a variant of the household dishwasher 1 in FIG. 1.

In FIG. 2, a situation is shown in which a user of the household dishwasher 1 subsequently loads soiled items to be washed 20 into a receptacle for items to be washed 12, after a wash program has already been started. The door 3 is therefore shown as being in a slightly opened position and the receptacle for items to be washed 12, which is already loaded with items to be washed 15, is pulled out from the washing chamber 4 by a small amount. The subsequently loaded soiled item to be washed 20, here a plate, has a great degree of soiling 22.

Arranged on the rear wall 9 of the household dishwasher 1 are a controller apparatus 100 and an evaluating unit 120. Arranged on a front edge of the ceiling 8 of the dishwasher cavity 2 directed towards the door 3 is an optical sensor 110. A capture region of the optical sensor 110 is indicated by the dashed lines. It can be seen that the region captured by the optical sensor 110 also protrudes out from the dishwasher cavity 4.

An arrow represents how the user introduces the soiled plate 20 into the receptacle for items to be washed 12. In this context, the user also moves the plate 20 through the region captured by the optical sensor 110. The optical sensor 110 thus captures an optical sensor signal of the subsequently loaded soiled plate 20.

The optical sensor 110 transmits the captured optical sensor signal to the evaluating unit 120. The evaluating unit 120 ascertains, as a function of the captured optical sensor signal, that a greatly soiled plate 20 has been subsequently loaded.

Consequently, the evaluating unit 120 determines a point in time of the subsequent loading. For example, the determined point in time is ten minutes after a cleaning sub-program step has begun. This means that an adding unit (not shown) has already added cleaning agent into the washing liquor. For example, this involves an adding unit which, on a first actuation by the controller apparatus 100, adds a single dispensing of cleaning agent previously dosed by the user into the washing chamber 4 and, on a further actuation, adds rinse-aid in each case. However, such an adding unit is reset by the opening of the door 3 for example, meaning that the first actuation after opening the door 3 corresponds to the first actuation, in which only cleaning agent, but not rinse-aid, is added. This would thus result in the problem of insufficient rinse-aid being added, if no corresponding countermeasure, as described below, is undertaken.

As a result of the great deal of soiling 22 of the plate 20 and due to the resetting of the adding unit by the door opening, the evaluating unit 120 identifies that the subsequent loading of the plate 20 has negative effects on the items to be washed 15, 20 as a whole in relation to the achievable cleaning result, if the wash program is continued unaltered. In order to achieve a predefined cleaning result in spite of the subsequent loading, the evaluating unit 120 performs the following predetermined actions. The washing liquor temperature of the washing liquor during the cleaning sub-program step is increased, for example from previously 50° C. to 65° C. In addition, the evaluating unit 120 prolongs the cleaning sub-program step by 10 minutes, for example. Moreover, the evaluating unit 120 sets the adding unit to add rinse-aid. Furthermore, the evaluating unit 120 outputs a corresponding item of information to the user. This comprises in particular the notice that the entire washing process will now finish ten minutes later.

Using these measures, it is thus ensured that a predefined cleaning result is achieved for the items to be washed 15, 20 as a whole.

Figure 3:
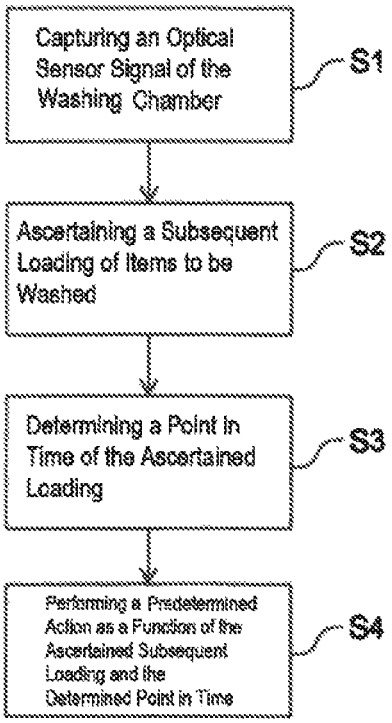
FIG. 3 shows a schematic block diagram of an exemplary embodiment of a method for operating a household dishwasher.

FIG. 3 shows a block diagram of an exemplary embodiment of a method for operating a household dishwasher 1, such as the household dishwasher 1 in FIG. 1 or FIG. 2 for example.

In a first method step S1, an optical sensor signal of the washing chamber 4 is captured by means of an optical sensor 110 during a performance of a wash program. The optical sensor signal in particular also comprises items to be washed 15, 20 arranged in the washing chamber 4.

In a second method step S2, an evaluating unit 120 ascertains a subsequent loading of items to be washed 20 by a user as a function of the captured optical sensor signal. For example, the evaluating unit 120 performs an image analysis of the captured optical sensor signal for this purpose.

In a third method step S3, the evaluating unit 120 determines a point in time of the ascertained subsequent loading in the wash program.

In a fourth method step S4, the evaluating unit 120 performs a predetermined action as a function of the ascertained subsequent loading and the determined point in time. The predetermined action in particular comprises measures which contribute to the items to be washed 15, 20 as a whole having a predefined cleaning result after the current wash program has concluded.

Although the present invention has been described with reference to exemplary embodiments, it can be modified in numerous different ways.

The invention claimed is:

1. A household dishwasher, comprising:

a washing chamber;

a controller apparatus configured to perform a wash program from a plurality of wash programs for washing items to be washed arranged in the washing chamber;

an optical sensor configured to capture an optical sensor signal of the washing chamber during performance of the wash program; and an evaluating unit configured to ascertain a subsequent loading of items to be washed by a user during performance of the wash program such that the wash program is interrupted as a function of the captured optical sensor signal of the washing chamber, configured to determine a point in time of the subsequent loading of items to be washed by the user during performance of the wash program but before an entire wash program has finished and stopped, such that the evaluating unit is configured to determine, in relation to the performed wash program, whether an addition of a cleaning agent has already taken place, whether a pre-rinsing has already been finished, whether a cleaning has already been finished, and whether a rinsing has already been started, and configured to perform a predetermined action as a function of the ascertained subsequent loading and the determined point in time, wherein the subsequent loading of items to be washed by the user during performance of the wash program comprises the user subsequently loading at least one soiled item to be washed into the washing chamber after the wash program has already been started.

2. The household dishwasher of claim 1, wherein the predetermined action comprises an output of an item of information to the user and/or an adjustment of the wash program currently being performed.

3. The household dishwasher of claim 1, wherein the evaluating unit is configured to determine the subsequent loading of items to be washed into the washing chamber as a function of an opening of a door of the household dishwasher and a closing of the door within a predetermined period of time while performing the wash program.

4. The household dishwasher of claim 1, further comprising an illumination device for illuminating the washing chamber when capturing the optical sensor signal.

5. The household dishwasher of claim 1, wherein the optical sensor comprises a camera, with the optical sensor signal comprising an image and/or a video of the washing chamber.

6. The household dishwasher of claim 5, wherein the evaluating unit is configured to perform an image analysis of the captured image and/or of the captured video in order to ascertain the subsequent loading of items to be washed.

7. The household dishwasher of claim 1, wherein the evaluating unit is configured to perform a spectral analysis of the captured optical sensor signal in order to ascertain the subsequent loading of items to be washed.

8. The household dishwasher of claim 1, wherein the evaluating unit is configured to ascertain a quantity of the subsequently loaded items to be washed, a type of the subsequently loaded items to be washed, a position of the subsequently loaded items to be washed in the washing chamber, and/or a degree of soiling of the subsequently loaded items to be washed as a function of the captured optical sensor signal.

* * * * *